US006328544B1

(12) United States Patent
Kawahara et al.

(10) Patent No.: US 6,328,544 B1
(45) Date of Patent: Dec. 11, 2001

(54) LINEAR COMPRESSOR

(75) Inventors: Sadao Kawahara; Teruyuki Akazawa, both of Shiga (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 0 days.

(21) Appl. No.: 09/441,778

(22) Filed: Nov. 17, 1999

(30) Foreign Application Priority Data

Nov. 19, 1998 (JP) ..... 10-346545

(51) Int. Cl.[7] ..... F04B 17/04
(52) U.S. Cl. ..... 417/416; 417/417
(58) Field of Search ..... 417/416, 417, 417/552

(56) References Cited

U.S. PATENT DOCUMENTS

| | | | | |
|---|---|---|---|---|
| 1,234,684 | * | 7/1917 | Niebling | 417/491 |
| 1,556,059 | * | 10/1925 | Williams | 417/416 |
| 1,789,694 | * | 1/1931 | Beman | 417/416 |
| 2,865,559 | * | 12/1958 | Gigler | 230/55 |
| 3,058,649 | | 10/1962 | Plegat | 230/55 |
| 3,490,684 | * | 1/1970 | Rietveld et al. | 230/55 |
| 3,543,061 | * | 11/1970 | Wallace | 103/53 |
| 4,032,264 | * | 6/1977 | Takahashi | 417/417 |
| 4,401,418 | | 8/1983 | Fritchman | 412/312 |
| 5,275,542 | * | 1/1994 | Terauchi | 417/417 |
| 5,355,108 | | 10/1994 | Morinigo et al. | 335/262 |
| 5,435,700 | | 7/1995 | Park | 412/312 |
| 5,451,727 | | 9/1995 | Park | 181/229 |

* cited by examiner

*Primary Examiner*—Timothy S. Thorpe
*Assistant Examiner*—Timothy P. Solak
(74) *Attorney, Agent, or Firm*—Armstrong, Westerman, Hattori, McLeland & Naughton, LLP

(57) ABSTRACT

A linear compressor comprises a cylinder supported in a hermetic vessel by a supporting mechanism, a piston which is concentric with the cylinder and is slidably supported along its axial direction, and a linear motor for generating thrust force by forming a magnetic passage by a movable portion secured to the piston and a stationary portion secured to the cylinder, in which refrigerant introduced into the hermetic vessel from a suction tube is inhaled and compressed by reciprocating motion of the piston driven by the linear motor and the compressed refrigerant is discharged out from the hermetic vessel, wherein the suction tube is provided in the vicinity of a suction port leading to a compression chamber formed by the piston and the cylinder. With this structure, the refrigerant introduced from the suction tube is not heated by a linear motor, and the compressing efficiency can be prevented from being lowered.

5 Claims, 2 Drawing Sheets

LINEAR COMPRESSOR

BACKGROUND OF THE INVENTION (1) Field of the Invention

The present invention relates to a linear compressor for drawing and compressing refrigerant by a reciprocating motion of a piston driven by a linear motor.

(2) Description of the Prior Art

In refrigeration cycle, it is said that HCFC-based refrigerants such as R22 are stable compounds and decompose the ozone layer. In recent years, HFC-based refrigerants begin to be utilized as alternative refrigerants of HCFCs, but these HFC-based refrigerants have the nature for facilitating the global warming. Therefore, people start employing HC-based refrigerants which do not decompose the ozone layer or largely affect the global warming. However, since this HC-based refrigerant is flammable, it is necessary to prevent explosion or ignition so as to ensure the safety. For this purpose, it is required to reduce the amount of refrigerant to be used. On the other hand, the HC-based refrigerant itself does not have lubricity and is easily melted into lubricant. For these reasons, when the HC-based refrigerant is used, an oil less or oil pure compressor is required, and a linear compressor in which almost no load is applied in a direction perpendicular to an axis of its piston is effective. In this linear compressor, all of its constituent elements arc accommodated in a hermetic vessel, and as a suction tube 85' for introducing the refrigerant into the hermetic vessel, a vessel which is fixed to a rear end plate 81 of a hermetic vessel 80 shown with phantom lines in FIG. 1 is employed.

Although details will be described latter, a piston 20 comprises a rod 22 and a piston head 28 mounted to a front end of the rod 22. Refrigerant introduced from the suction tube 85' into a space 84 of the hermetic vessel 80 passes through the hermetic vessel 80 and mainly through an outer periphery of an outer yoke 52, and is introduced from a suction port 15 of a cylinder 10, and is inhaled and compressed in the piston head 28 and discharged from a discharge mechanism 60.

In this linear compressor, since the piston 20 is provided around its outer periphery with a linear motor 30, the refrigerant introduced into the space 84 from the Suction tube 85' flows forward through a gap between an inner surface of the hermetic vessel 80 and the linear motor 30, and is introduced to the piston head 28 from the suction port 15. By allowing the refrigerant introduced into the hermetic vessel 80 to pass through the linear motor 30 in this manner, the linear motor 30 can be cooled, but the refrigerant is adversely heated. Therefore, there is a problem as compared with refrigerant which is not heated, the compressing efficiency of the refrigerant is lowered correspondingly.

The present invention has been accomplished to solve the above problem, and it is an object of the invention to provide a linear compressor in which a mounting position of a suction tube is contrived to prevent the compressing efficiency from being lowered.

A linear compressor according to a first aspect of the present invention comprises a cylinder supported in a hermetic vessel by a supporting mechanism, a piston which is concentric with the cylinder and is slidably supported along its axial direction, and a linear motor for generating thrust force by forming a magnetic passage by a movable portion secured to the piston and a stationary portion secured to the cylinder, in which refrigerant introduced into the hermetic vessel from a suction tube is inhaled and compressed by reciprocating motion of the piston driven by the linear motor and the compressed refrigerant is discharged out from the hermetic vessel, wherein the suction tube is provided in the vicinity of a suction port leading to a compression chamber formed by the piston and the cylinder.

In the linear compressor according to the first aspect of the present invention, the suction tube for drawing refrigerant is disposed in the vicinity of the suction port leading to the compression chamber. Thus, refrigerant from the suction tube is directly introduced into the compression chamber provided in the vicinity of the suction tube. Therefore, since the refrigerant introduced from the suction tube is not heated by a linear motor, the compressing efficiency is prevented from being lowered.

According to a second aspect, in the linear compressor of the first aspect, the suction tube is opposed to the suction port.

In the linear compressor according to the second aspect of the invention, the suction tube is provided such as to be opposed to the suction port. Therefore, the refrigerant from the suction tube is smoothly and directly introduced to the suction port.

According to a third aspect, in the linear compressor of the first aspect, the suction tube is disposed in a region between a discharge mechanism disposed at one end side of the piston and the linear motor disposed at the other end side of the piston.

In the linear compressor according to the third aspect of the present invention, the suction tube is disposed in the region separated from the linear motor and the discharge mechanism which are heated to high temperature when the compressor is operated. Therefore, the flexibility of positioning of the suction tube is enhanced, the refrigerant is prevented from being heated by the linear motor and the discharge mechanism, and the compressing efficiency is prevented from being lowered.

According to a fourth aspect, in the linear compressor of the first aspect, the piston comprises a piston head and a rod, the linear motor is disposed around an outer periphery of the rod, and the suction port is formed in the cylinder which is adjacent the piston head.

In the linear compressor according to the fourth aspect of the present invention, the suction tube for introducing refrigerant is disposed in the vicinity of the piston head. Thus, the refrigerant from the suction tube is directly introduced to the piston head from the suction port provided in the vicinity of the suction tube. Therefore, the refrigerant introduced from the suction tube is not heated by the linear motor, and the compressing efficiency is prevented from being lowered.

According to a fifth aspect, in the linear compressor of the fourth aspect, the piston head is formed at its one end with the compression chamber and at its other end with a space, the piston head includes a through hole which brings the compression chamber and the space into communication with each other, the piston head also includes a suction valve which opens and closes the through hole, and the suction port is in communication with the space.

In the linear compressor according to the fifth aspect of the present invention, refrigerant introduced to the piston head is introduced into the compression chamber through the space and a through hole, and is inhaled and compressed by operation of a suction valve. Therefore, an influence of heat from high temperature discharged refrigerant is small, and refrigerant can be inhaled and compressed smoothly and efficiently.

DESCRIPTION OF THE PREFERRED EMBODIMENTS

Figure 1:
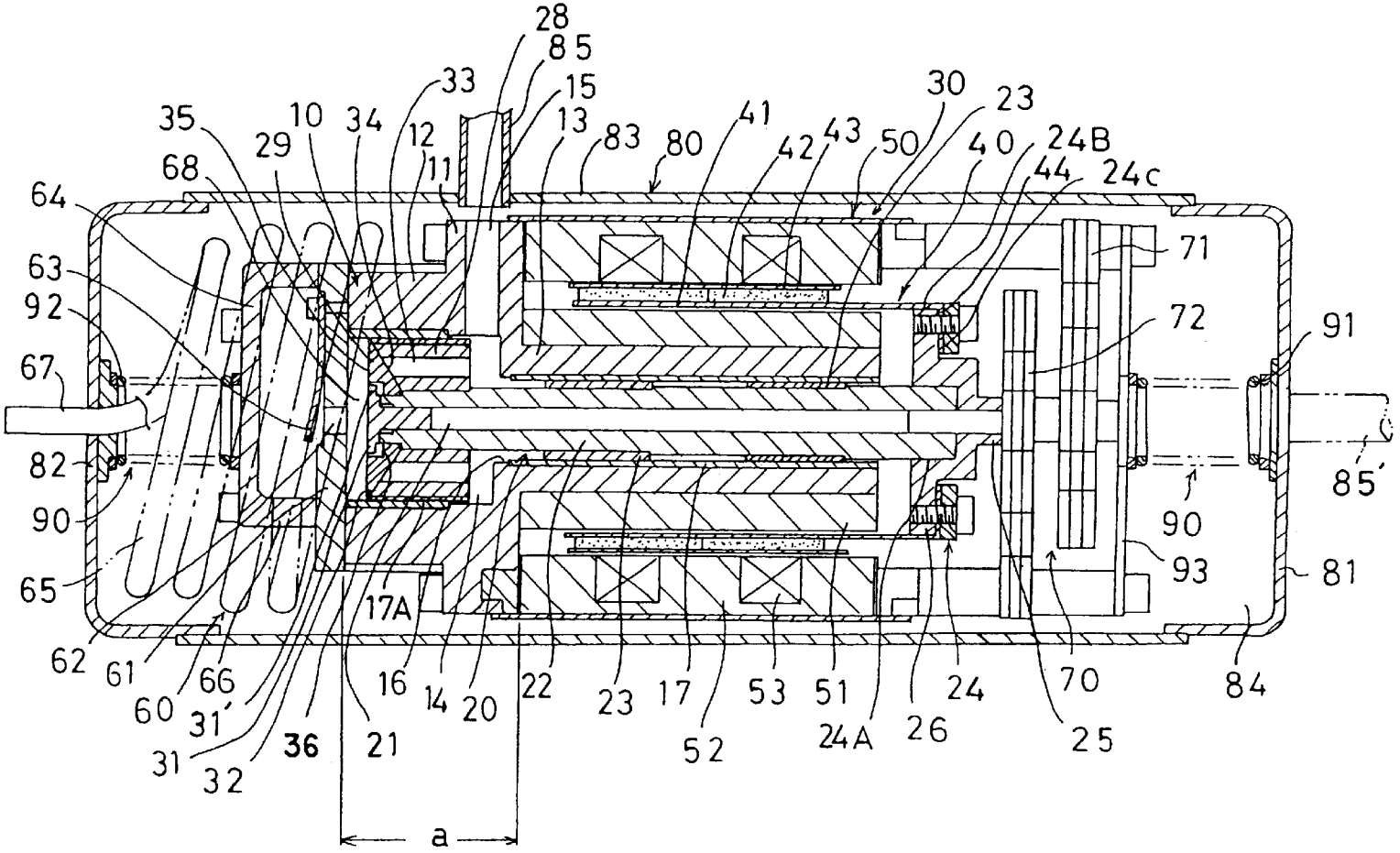
FIG. 1 is a sectional view showing the entire structure of a linear compressor of an embodiment of the present invention.
Figure 2:
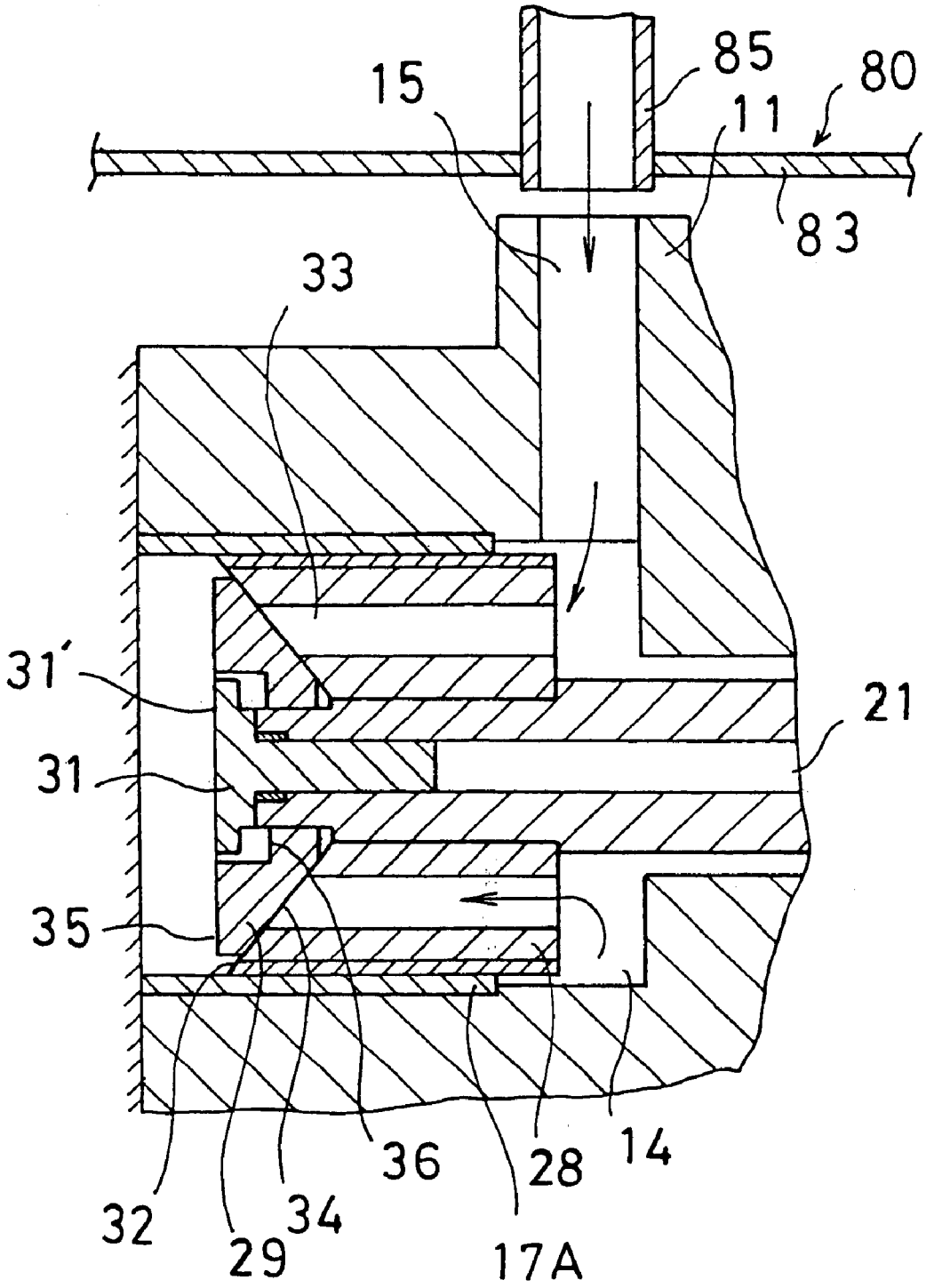
FIG. 2 is an enlarged partial sectional view showing a detailed structure around an open/close mechanism.

An embodiment of a linear compressor of the present invention will be explained based on the drawings. FIG. 1 is a sectional view showing the entire structure, and FIG. 2 is an enlarged view of an essential portion of FIG. 1. First, the entire structure of the linear compressor of the invention will be explained. This linear compressor comprises a cylinder 10, a piston 20, a movable portion 40 and a stationary portion 50 both constituting a linear motor 30, a discharge mechanism 60, a spring mechanism 70, a hermetic vessel 80 and a supporting mechanism 90.

The cylinder 10 is integrally formed with a brim 11, a boss 12 projecting leftward in the drawing (forward) from the brim 11, a cylindrical body 13 for holding the piston 20 and the like. A space 14 for forming a compression chamber in which a piston head 28 is disposed is formed in the boss 12. A suction port 15 provided at the side of the brim 11 is in communication with the space 14. A cylinder bore 16 formed in the cylindrical body 13 is in communication with the space 14 and a rear end thereof is opened. A thin ring 17 made of metal is fitted to an inner surface of the cylinder bore 16. In the present embodiment, the cylinder 10 is made of aluminum, and the ring 17 is provided for enhancing the sliding performance. A ring 17A is fitted to the boss 12 of the cylinder 10.

As shown in FIGS. 1 and 2, the piston 20 comprises a rod 22 forming an inner hole 21 and a piston head 28. The piston 20 is made of aluminum material in the present embodiment. By making the piston 20 of aluminum material, it is possible to reduce its weight, and to lower the rigidity of a spring mechanism 70 which will be described later. In order to enhance the wear resistance of the piston 20, a divided steel thin liner 23 is fitted to outer peripheries of the rod 22 and the piston head 28. The steel thin liner 23 is slidably held by the ring 17 at the side of the cylinder 10. The piston 20 is provided at its rear end with a flange 24, and at its front end with the piston head 28. The flange 24 is formed at its central portion with a hole 24A to which the piston 20 is fitted, and includes a side surface 24B which is concentric with an axis of the piston 20, an end surface 24C formed perpendicular to the axis of the piston 20 and adjacent the side surface 24B, and a connecting shaft 25 to be connected with the spring mechanism 70. A ring-like pushing plate 26 which abuts against the end surface 24C is fixed to the flange 24. Since the flange 24 is detachably threaded to the piston 20, the steel thin liner 23 is inserted into the outer periphery of the rod 22 of the piston 20 from the side of the flange 24, a position of the liner 23 is restricted by a step and fitted.

The piston head 28 comprises a suction valve 29 provided at the side of the front end opening of the piston 20, and a stopper member 31 forming a stopper portion 31' which movably supports the suction valve 29 in its axial direction and which restricts the moving amount thereof. A tapered surface 32 is formed at the side of the front end opening. A plurality of through holes 33 through which the inhaled refrigerant passes are formed, and the through holes 33 are in communication with the suction port 15. A shaft of the stopper member 31 is fitted into the inner hole 21 of the piston 20, and the stopper member 31 is fixed to a tip end of the piston head 28. The suction valve 29 includes a tapered portion 34 which abuts against the tapered surface 32 of the piston head 28, the tapered portion 34 comprises a cone member which is formed at its front end with a flat surface 35, and the suction valve 29 is slidably supported by a tip end of the piston 20.

A stepped surface 36 abutting against the stopper portion 31' through an appropriate distance is formed on the suction valve 29. With the above-described structure, the suction valve 29 can move along the axial direction of the piston 20 by the above-described distance. When the piston 20 moves in a direction that compresses refrigerant, the tapered portion 34 of the suction valve 29 abuts against the tapered surface 32 of the piston head 28 to close the through holes 33.

Although the rod 22 and the piston head 28 are formed of separate members, they may be formed integrally.

Next, the linear motor 30 will be explained. As described above, the linear motor 30 comprises the movable portion 40 and the stationary portion 50. First, the movable portion 40 comprises a cylindrical holding member 41, a permanent magnet 42 and a cylindrical body 43. The stationary portion 50 comprises an inner yoke 51, an outer yoke 52 and a coil 53. All of the cylindrical holding member 41, the permanent magnet 42 and the cylindrical body 43 of the movable portion 40 are cylindrical in shape, and are disposed concentrically with the piston 20. The cylindrical holding member 41 is made of a thin member, and is disposed such that a rear end thereof is in contact with the side surface 24B of the flange 24. The cylindrical holding member 41 is fitted to the flange 24 or fixed by fixing means (not shown). With the above-described structure, the cylindrical holding member 41 is disposed concentrically with the piston 20.

The permanent magnet 42 is disposed such as to be in contact with the cylindrical holding member 41. The cylindrical body 43 is disposed such as to be in contact with the permanent magnet 42. In the present embodiment, the permanent magnet 42 is sandwiched between the cylindrical holding member 41 and the cylindrical body 43. The cylindrical holding member 41, the permanent magnet 42 and the cylindrical body 43 are disposed concentrically with the piston 20 with high precision.

As described above, the stationary portion 50 comprises the inner yoke 51, the outer yoke 52 and the coil 53. In the present embodiment, the inner yoke 51 is cylindrical in shape and in contact with the cylindrical portion 13 and secured to the brim 11. A fine gap is formed between an outer periphery of the inner yoke 51 and the cylindrical holding member 41. With the above-described structure, the inner yoke 51, the cylinder 10 and the piston 20 are disposed concentrically. The outer yoke 52 is also cylindrical in shape, and is disposed such that a fine gap is formed between the outer yoke 52 and an outer periphery of the cylindrical body 43. The outer yoke 52 is secured to the brim 11 of the cylinder 10. With the above-described structure, the movable portion 40 and the stationary portion 50 are concentrically held with high precision.

Next, the discharge mechanism 60 will be explained. A discharge valve supporting member 61 is secured to a front end of a cylinder 10, and a discharge hole 62 is formed in a central portion of the discharge valve supporting member 61. A discharge valve 63 is provided in the discharge hole 62. A muffler 64 is secured to the discharge valve supporting member 61. A base end of a spiral discharge tube 65 is connected to a discharge port 66 of the muffler 64, and a front end of the spiral discharge tube 65 is connected to a discharge tube 67. As shown in the drawing, the spiral discharge tube 65 is made of pipe member which is bent into a spiral shape. A portion of the spiral discharge tube 65 is wound around outer peripheral spaces of the cylinder 10 and the muffler 64. The spiral discharge tube 65 and the discharge tube 67 may be integrally formed, or may be formed separately and connected to each other.

Next, the spring mechanism 70, the hermetic vessel 80 and the supporting mechanism 90 will be explained based on FIG. 1.

The spring mechanism 70 comprises a flat spring plate 71 disposed rearward. As shown in the drawing, a rear edge of the spring plate 71 is supported by the cylinder 10, and the spring plate 71 is connected to the flange 24. The spring plate 71 comprises a plurality of plate-like spring materials 72 which are superposed on one another.

The hermetic vessel 80 is a cylindrical vessel comprising a rear end plate 81, a front end plate 82 and a cylindrical body 83 secured between the rear end plate 81 and the front end plate 82, and the hermetic vessel 80 is formed with a space 84 therein. Constituent elements of the linear compressor are accommodated in the space 84. The front end plate 82 is provided with the discharge tube 67.

As shown in FIGS. 1 and 2, a suction tube 85 is fixed to an intermediate portion of the cylindrical body 83 of the hermetic vessel 80. As described above, in the present invention, the linear motor 30 is provided around the outer periphery of the rod 22 of the piston 20. The suction tube 85 is located at a position deviated from the linear motor 30 as illustrated in the drawing. As shown in FIG. 1, the suction tube 85 is located at a position deviated from the discharge valve supporting member 61 which holds the muffler 64 and the discharge valve 63 of the discharge mechanism 60. That is, it is preferable that the suction tube 85 is disposed in a region designated by the small letter_a in FIG. 1. In the drawing, the suction tube 85 is disposed closer to the linear motor 30, and is disposed at a position opposed to the suction port 15 provided in the brim 11 of the cylinder 10.

The supporting mechanism 90 comprises an other end-side coil spring 91 and a one-side coil spring 92. The other end-side coil spring 91 is disposed between a bridging plate 93 fixed to the cylinder 10 and a rear end plate 81 of the hermetic vessel 80. The on-side coil spring 92 is disposed between the muffler 64 and a front end plate 82 of the hermetic vessel 80. The other end-side coil spring 91 and the one-side coil spring 92 are provided for preventing the vibration transmitted to the cylinder 10 from being transmitted to the hermetic vessel 80.

The operation of the linear compressor of the present embodiment will be explained.

First, if the coil 53 of the stationary portion 50 is energized, thrust which is proportional to the current in accordance with Fleming's left-hand rule is produced between the movable portion 40 and the permanent magnet 42. By this produced thrust, driving force for retreating the movable portion 40 along the axial direction is generated. Since the cylindrical holding member 41 of the movable portion 40 is secured to the flange 24, and the flange 24 is connected to the piston 20, the piston 20 is retreated. Since the piston 20 is slidably supported in the cylinder 10, the piston 20 is retreated along its axial direction.

As the piston 20 is retreated, since the suction valve 29 is freely supported by the piston head 28, a gap is generated therebetween by the retreating motion of the piston 20.

Here, the coil 53 is energized with sine wave, thrust force in the normal direction and thrust force in the reverse direction are alternately generated in the linear motor. By the alternately generated thrust force in the normal direction and thrust force in the reverse direction, the piston 20 reciprocates.

The refrigerant is introduced into the hermetic container 80 from the intake tube 85. The refrigerant introduced into the hermetic container 80 is introduced into the space 14 of the cylinder 10 from the intake port 15 of the cylinder 10 disposed in the vicinity of the suction tube 85. This refrigerant enters into the intake compressing chamber 68 from the gap generated between the tapered portion 34 of the on-off valve 29 and the tapered surface 32 of the piston body 28 by the retreating motion of the piston 20. The refrigerant in the intake compressing chamber 68 is compressed by the advancing motion of the piston 20. The compressed refrigerant opens the discharge valve 63, passes through the discharge hole 62 of the discharge valve supporting member 61, enters into the muffler 64 where the refrigerant is dispersed and noise is reduced, and the refrigerant enters into the spiral discharge tube 65 from the discharge port 66, and the refrigerant is discharged outside from the discharge tube 67.

As described above, since the suction tube 85 is disposed in the vicinity of the suction port 15, the suction tube 85 does not easily receive heat from the linear motor 30 and the discharge mechanism 60. Therefore, the refrigerant introduced into the suction port 15 from the suction tube 85 is not heated almost at all, and is introduced into the through holes 33, and inhaled and compressed by the suction valve 29. With the above structure, the compressing efficiency is prevented from being lowered.

According to the present invention, by disposing the suction tube in the vicinity of the suction mechanism of the piston body in a region deviated from the linear motor and the discharge mechanism, it is possible to prevent refrigerant introduced from the suction tube from being heated, and to prevent the compressing efficiency from being lowered.

What is claimed is:

1. A linear compressor comprising:

a cylinder, comprising a brim, a boss projecting from the brim and a cylindrical body for holding a piston, supported in a hermetic vessel by a supporting mechanism, a piston which is concentric with said cylinder and is slidably supported along its axial direction, a space for forming a compression chamber in which a piston head is disposed, said space formed in the boss, a suction port provided at a side of the brim, the suction port in communication with said space, a cylinder bore formed in the cylindrical body, the cylinder bore in communication with said space and a rear end thereof is opened, and a linear motor for generating thrust force by forming a magnetic passage by a movable portion secured to said piston and a stationary portion disposed at an outer periphery of the cylindrical body and secured to the brim, in which refrigerant introduced into said hermetic vessel from a suction tube is inhaled and compressed by reciprocating motion of said piston driven by said linear motor and the compressed refrigerant is discharged out from said hermetic vessel, where said suction tube is provided in the vicinity of said suction port leading to a compression chamber formed by said piston and said cylinder.

2. A linear compressor according to claim 1, wherein said suction tube is opposed to said suction port.

3. A linear compressor according to claim 1, wherein said suction tube is disposed in a region between a discharge mechanism disposed at one end side of said piston and said linear motor disposed at the other end side of said piston.

4. A linear compressor according to claim 1, wherein said piston comprises a piston head and a rod, said linear motor is disposed around an outer periphery of said rod, and said suction port is formed in said cylinder which is adjacent said piston head.

5. A linear compressor according to claim 4, wherein said piston head is formed at its one end with said compression chamber and at its other end with a space, said piston head includes a through hole which brings said compression chamber and said space into communication with each other, said piston head also includes a suction valve which opens and closes said through hole, and said suction port is in communication with said space.

* * * * *